US006854818B2

(12) United States Patent
Gomoll et al.

(10) Patent No.: US 6,854,818 B2
(45) Date of Patent: Feb. 15, 2005

(54) REFRIGERATOR

(75) Inventors: Günter Gomoll, Elchingen (DE); Hans-Reinhart Janssen, Giengen (DE)

(73) Assignee: SH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/364,818

(22) Filed: Feb. 11, 2003

(65) Prior Publication Data

US 2003/0173881 A1 Sep. 18, 2003

Related U.S. Application Data

(63) Continuation of application No. PCT/EP01/08911, filed on Aug. 1, 2001.

(30) Foreign Application Priority Data

Aug. 11, 2000 (DE) ..... 100 39 362

(51) Int. Cl.[7] ..... A47B 96/04
(52) U.S. Cl. ..... 312/404; 312/408
(58) Field of Search ..... 312/404, 408, 312/410, 407, 330.1, 311, 401; 62/378, 382

(56) References Cited

U.S. PATENT DOCUMENTS

| | | | | |
|---|---|---|---|---|
| 1,837,293 A | | 12/1931 | Sanford | |
| 2,103,885 A | * | 12/1937 | Whalen | 312/404 |
| 2,649,351 A | | 8/1953 | Rothchild | |
| 2,717,189 A | | 9/1955 | Teague et al. | |
| 2,795,117 A | | 6/1957 | Herndon, Jr. et al. | |
| 2,825,617 A | | 3/1958 | Morgan | |
| 2,926,507 A | | 3/1960 | Ingolia | |
| 5,848,534 A | * | 12/1998 | Stauffer | 62/91 |
| 5,953,931 A | * | 9/1999 | Brittain | 62/272 |
| 5,980,009 A | * | 11/1999 | Atalla et al. | 312/408 |
| 6,019,447 A | | 2/2000 | Jackovin | |
| 6,547,349 B2 | * | 4/2003 | Sessa et al. | 312/352 |

FOREIGN PATENT DOCUMENTS

| | | | | |
|---|---|---|---|---|
| DE | 3114299 A1 | * | 12/1982 | 312/404 |
| EP | 0 862 153 A2 | | 9/1998 | |
| WO | WO 88/07341 | | 10/1988 | |

* cited by examiner

*Primary Examiner*—Lanna Mai
*Assistant Examiner*—Hanh V. Tran
(74) *Attorney, Agent, or Firm*—Laurence A. Greenberg; Werner H. Stemer; Ralph E. Locher

(57) ABSTRACT

A table-top refrigerator includes a refrigerated chamber equipped with trays disposed one on top of the other in the form of a filter, which may be drawn out of the refrigerated chamber by telescopic extensions. One of the trays has an opening edge stepped such as to slope in the directions of displacement and a tray disposed over the above has a stepped tray floor. The backward facing sections are, thus, substantially congruent in form.

21 Claims, 2 Drawing Sheets

REFRIGERATOR

CROSS-REFERENCE TO RELATED APPLICATION

This application is a continuation of copending International Application No. PCT/EP01/08911, filed Aug. 1, 2001, which designated the United States and was not published in English.

BACKGROUND OF THE INVENTION

1. Field of the Invention

The invention relates to a free-standing refrigerator, such as a table refrigerator, upright refrigerator, or the like, having a heat-insulating housing within which there is provided a refrigerating chamber that is equipped with at least two depositing compartments for refrigerator items and can be closed by a door that can be pivoted about a vertical axis of rotation.

It is prior-art practice, for example, in the case of table refrigerators, to equip the refrigerating chambers of the latter with depositing compartments in the form of shelves, for example, glass supporting panels, wire supporting grilles, or the like, for refrigerator items. Such measures for refrigerator items already make it possible, in a cost-effective manner, to provide depositing compartments with the aid of which a certain system is achieved, within a refrigerating chamber, for the purpose of setting in order the refrigerator items that are to be stored. However, the known depositing compartments are disadvantageous in relation to the operations of removing refrigerator items and loading the same because, in particular, the depositing-compartment section that is provided in the rear part of the refrigerating chamber can only ever be accessed by a user who is in a stooped, and, thus, uncomfortable, position. It is also extremely difficult to get an overview, in particular, of the refrigerator items set down in the rear region because it is only possible to see this region of the depositing compartments if one is in a stooped position. As a result of the rear depositing-compartment region that is difficult to see, it has been found that it is often only the clearly visible region of the depositing compartments in the vicinity of the door that is utilized for setting down refrigerator items. This habit decreases the accommodating volume to a considerable extent, this being brought about by the poor accessibility of the rear region of the depositing compartment. As a result of the utilization of the depositing compartments being restricted for access-related reasons, and as a result of the poor accessibility of these depositing compartments over the depth of the refrigerating chamber, the usefulness of the known refrigerators is reduced to a considerable extent.

SUMMARY OF THE INVENTION

It is accordingly an object of the invention to provide a refrigerator that overcomes the hereinafore-mentioned disadvantages of the heretofore-known devices of this general type and that avoids the disadvantages of the prior art using straightforward design measures and, thus, achieves a considerable increase in the usefulness of this type of appliance.

With the foregoing and other objects in view, there is provided, in accordance with the invention, a free-standing refrigerator, including a heat-insulating housing defining therewithin a refrigerating chamber, a door pivotally connected to the housing, the door pivoting about a vertical axis of rotation and closing the refrigerating chamber from the outside, telescopic rails connected to the refrigerating chamber, at least two depositing compartments for holding refrigerator items, the at least two depositing compartments being container-shaped and being connected to respective ones of the telescopic rails in the refrigerating chamber and, thereby, moving in and out of the refrigerating chamber in a movement direction through the telescopic rails, a first of the at least two depositing compartments having a loading opening and being offset at the loading opening by at least one step disposed transversely to the movement direction to form first accommodating chambers of different heights, and a second of the at least two depositing compartments disposed above the first depositing compartment in the refrigerating chamber, the second depositing compartment having a compartment base offset in a step transversely to the movement direction on at least one location to form second accommodating chambers of different heights. The free-standing refrigerator can be a table refrigerator or an upright refrigerator. The door is heat insulating.

According to the invention, the depositing compartments are of container-like configuration and can be moved out of the refrigerating chamber by way of correspondingly associated telescopic rails, one of the depositing compartments, for the purpose of forming accommodating chambers of different heights, being offset at its loading opening by at least one step disposed transversely to the movement direction of the depositing compartment, while the second depositing compartment, disposed above the first-mentioned depositing compartment, for the purpose of forming accommodating chambers of different heights, has a compartment base that is offset in a step-like manner at at least one location transversely to its movement direction.

The table-top refrigerator according to the invention includes a refrigerated chamber equipped with trays disposed one on top of the other in the form of a filter, which may be drawn out of the refrigerated chamber by telescopic extensions. One of the trays has an opening edge stepped such as to slope in the directions of displacement and a tray disposed over the above has a stepped tray floor. The backward facing sections are, thus, substantially congruent in form.

The use of container-like depositing compartments that can be moved out of the refrigerating chamber by way of telescopic rails, then, makes it possible in the case of table refrigerators, which are usually set down on the floor, for a user to be able to load refrigerator items into the depositing compartments in their rear region, remote from the door, or remove the items from the depositing compartments, at least in a furthermost part upright, and, thus, comfortable, position. In the state in which they are drawn out of the refrigerating chamber, this type of depositing compartment makes it possible for a user to be informed at a glance of the type of items stored in the refrigerator and of the remaining shelf life thereof. The step-like configuration of the depositing compartments straightforwardly gives a user an immediate indication, as a result of the accommodating chambers of different heights, on one hand, but also, on the other hand, of the stowage space created between the depositing compartments disposed one above the other, as to what type of refrigerator items is, or can be, stored in the accommodating or storage chambers of the different heights, which are produced by the individual steps. The stowage space between the depositing compartments can be optimized here by the latter being configured and disposed correspondingly. Moreover, the step-like configuration of the depositing compartments makes it possible to achieve optimized-volume utilization of the refrigerating chamber in a particularly straightforward manner. The step height within the depositing compartment, on one hand, and the height-wise spacing between the depositing compartments disposed one above the other, on the other hand, allow different setting heights, which are clearly visible to the user, for the purpose of storing refrigerator items, and, thus, serve as an orientation aid for locating the stored refrigerator items. By virtue of the depositing compartments being pulled out by way of the telescopic rails, access to the refrigerating chamber for the purpose of storing and/or removing refrigerator items is facilitated to a considerable extent even for the elderly and physically handicapped. Furthermore, the step-like configuration makes it possible, in a straightforward and cost-effective manner, for the refrigerating-chamber volume to be divided up in adaptation to the items that are usually stored in the refrigerator.

The refrigerator items that are stored in the accommodating chambers of the depositing compartments can be stored, and, thus, located again by a user, in particularly precise positions, if it is provided, in accordance with another feature of the invention, that the accommodating chambers are separated along the step by a wall. Such a wall, furthermore, also stiffens the container-like depositing compartments. Separation of the accommodating chambers of the depositing compartments along the step provides, for a user, a particularly expedient orientation aid for locating stored refrigerator items.

In accordance with a further feature of the invention, the setback sections of the depositing compartments, which are produced by the step-like offset formations, coincide with one another at least partially.

Designing and configuring the depositing compartments in this way already provides, in a straightforward manner, a first orientation aid for storing storage items in high multi-packs, such as bottles or the like.

The depositing compartments are configured and disposed in a particularly favorable manner for storing storage items packaged in high multi-packs if, in accordance with an added feature of the invention, the set-back sections of the depositing compartments coincide with one another at least for the most part. The large degree to which the set-back sections of the depositing compartments coincide does not just result in a corresponding accommodating volume for storage items in high multi-packs; in addition, the storage location of these storage items is clear to see and, as a result, the task of locating them is improved to a considerable extent.

In accordance with an additional feature of the invention, the depositing compartment with the opening plane offset in a step-like manner has an at least more or less planar-surface compartment base and is disposed in that region of the refrigerating chamber that is in the vicinity of the floor.

This results in particularly user-friendly loading and removal of storage items that are provided in high multi-packs.

In accordance with yet another feature of the invention, in the case of the depositing compartment with the opening plane offset in a step-like manner, the height of its accommodating chambers, which are formed by the step, is greater than the height of the accommodating chambers of the depositing compartment disposed above.

Configuring the depositing compartment of greater accommodating height in that region of the refrigerating chamber that is in the vicinity of the floor additionally facilitates the use, in particular, of a table refrigerator in that such a depositing compartment is usually loaded with large-format refrigerator items, as a result of which the size of the refrigerator items assists not only the loading of the refrigerator items, but also the removal thereof from the depositing compartment, even in that region of the table refrigerator that is in the vicinity of the floor.

The depositing compartment that is disposed in the vicinity of the floor is of particularly favorable design in respect of optimum utilization of the refrigerating-chamber volume if, in accordance with yet a further feature of the invention, the depositing compartment that is disposed in the vicinity of the floor has a shorter compartment section, which is provided with the greater compartment height and, in the case of a compressor niche projecting into the refrigerating chamber on one side, is seated in front of the niche and serves as a vegetable compartment.

In accordance with yet an added feature of the invention, the compartment section that serves as a vegetable compartment is of wider design than the second compartment section, which is disposed alongside the first compartment section in movement direction of the depositing compartment and is provided as a set-down compartment for storage items in high multi-packs, such as bottles or the like.

Such a configuration of the depositing compartment that is seated in front of the protruding niche projecting into the refrigerating chamber allows, in particular, for the storage of large-volume types of vegetable such as lettuce, cauliflower, or the like. These types of vegetable can, then, be accommodated within the vegetable compartment without being squashed, which may possibly result in premature damage.

In accordance with yet an additional feature of the invention, in addition to the two depositing compartments that are offset in a step-like manner, there is provided at least one further depositing compartment that can be moved out of the refrigerating chamber by way of telescopic rails, is disposed above the depositing compartment with the compartment base offset in a step-like manner, and is configured in the manner of a shallow tray.

This straightforwardly provides a further orientation aid for storing and locating refrigerator items within the refrigerating chamber.

In accordance with again an added feature of the invention, the second depositing compartment has a depositing-compartment section that is of low accommodating height, an egg compartment, and disposed above the another of the first accommodating chambers of the first depositing compartment.

In accordance with again an additional feature of the invention, the second depositing compartment has a depositing-compartment section that has an accommodating height and an egg compartment and is disposed above the another of the first accommodating chambers of the first depositing compartment.

The set-back compartment section of the depositing compartment that is provided with a step on its base is of particularly expedient design, in respect of an orientation aid for a user, if, in accordance with again another feature of the invention, the shallower compartment section of the depositing compartment that is provided with a step on its base is configured, at least in part, as an egg compartment.

The inner cladding that forms the inside of a refrigerator door is configured, on one hand, in a particularly aesthetically pleasing manner and, on the other hand, in a manner in which it can be used universally, and, thus, cost-effectively, for different types of appliance if, in accordance with again a further feature of the invention, the door, at least for the most part, is of planar-surface design on its inside, which is directed towards the refrigerating chamber.

In accordance with a concomitant feature of the invention, at least in its top section, the door has a shallow accommodating hollow for storing small-format refrigerator items, such as tubes or the like.

Such a configuration of the inner cladding that forms the inside of the refrigerator door provides accommodation for small-format refrigerator items that saves stowage space in the refrigerating chamber it being possible for the refrigerator items, as a result of the way in which they are accommodated, to be accessed in a rapid and specific and, thus, time-saving manner.

With the objects of the invention in view, there is also provided a free-standing refrigerator, including a heat-insulating housing defining therewithin a refrigerating chamber, a door pivotally connected to the housing, the door pivoting about a vertical axis of rotation and closing the refrigerating chamber from the outside, telescopic rails connected to the refrigerating chamber, at least two depositing compartments for holding refrigerator items, the at least two depositing compartments being container-shaped and being connected to the telescopic rails in the refrigerating chamber and, thereby, moving in and out of the refrigerating chamber in a movement direction through correspondingly associated ones of the telescopic rails, a first of the at least two depositing compartments having at least one step disposed parallel to the movement direction, the at least one step dividing the first depositing compartment into two sub-compartment having different depths to form first accommodating chambers of different heights, and a second of the at least two depositing compartments disposed above the first depositing compartment in the refrigerating chamber, the second depositing compartment having a step-shaped compartment base offset transverse to the movement direction on at least one location to form second accommodating chambers of different heights.

Other features that are considered as characteristic for the invention are set forth in the appended claims.

Although the invention is illustrated and described herein as embodied in a refrigerator, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
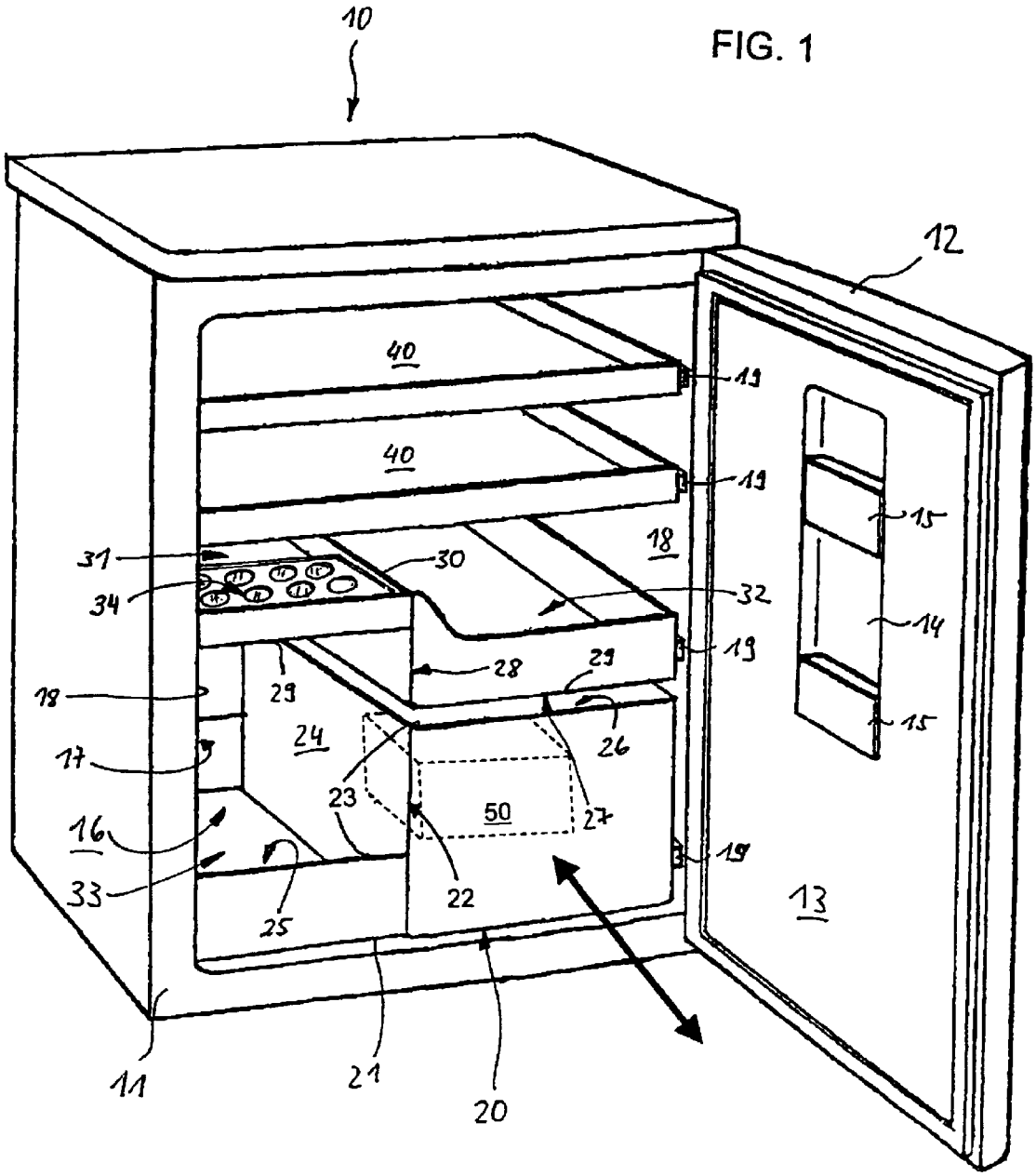
FIG. 1 is a perspective view of a table refrigerator according to the invention with the door open and having depositing compartments that are guided in a displaceable manner by way of telescopic rails in its refrigerating chamber and offset by a step.

Referring now to the figures of the drawings in detail and first, particularly to FIG. 1 thereof, there is shown a table refrigerator 10 with a heat-insulating housing 11 on which a door 12, of heat-insulating design, is disposed such that it can be pivoted about a vertical axis. The door 12 has an inner cladding 13 that substantially forms the inside of the door, is formed from a plastic panel without any cutting operation and contains, in the top section of the door 12, a shallow accommodating hollow 14 provided in the central region of the top section. Two accommodating containers 15 for storing small-format refrigerator items such as tubes or the like are inserted in the accommodating hollow 14 at a distance one above the other and, at least for the most part, in a surface-flush state.

A refrigerating chamber 16, which is disposed within the heat-insulating housing 12 and is lined with an inner plastic cladding 17 produced by non-cutting shaping, is accessible through the door 12. The cladding 17 is provided, on its two side walls 18, with telescopic rails 19 that are spaced apart vertically one above the other and are secured on the inner cladding 17 through non-illustrated backing parts that are disposed on the heat insulation. The telescopic rails 19 bear depositing compartments, which are explained in more detail below and are configured in the manner of containers.

Figure 2:
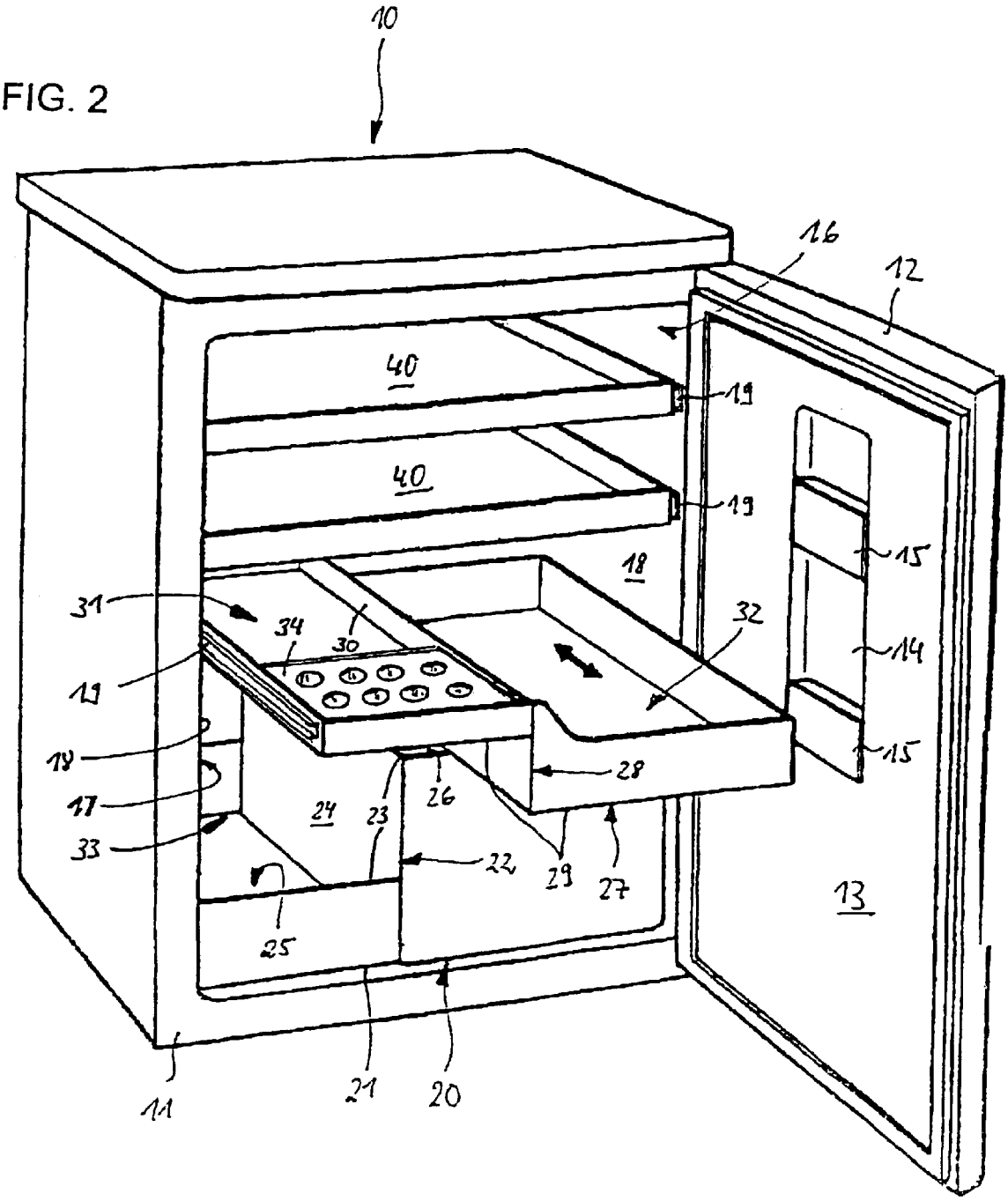
FIG. 2 is a perspective view from the front of the table refrigerator of FIG. 1, with one of the depositing compartments that are offset in a step-like manner drawn out of the refrigerating chamber.

As both FIG. 1 and FIG. 2 show, of the depositing compartments, a first depositing compartment 20 is disposed in that region of the refrigerating chamber 16 that is in the vicinity of the floor. The depositing compartment 20 is produced in one piece by plastic injection molding and has a planar-surface compartment base 21 disposed in the vicinity of the floor of the refrigerating chamber. Opposite the compartment base 21, the depositing compartment 20 has an opening plane 23, which is offset by a step 22 transversely to the movement direction of the depositing compartment (illustrated symbolically by a double arrow A). Two depositing-compartment sections 25 and 26 that are separated from one another by a partition wall 24 and have different compartment heights are formed on the depositing compartment 20, in the movement direction thereof, by the step 22. Of the depositing-compartment sections 25 and 26, the former section 25, which is set back in relation to the depositing-compartment section 26, has a lower compartment height. The depositing-compartment section 26, which is provided with a greater compartment height, is configured to be shorter than the depositing-compartment section 25 and is extended into the vicinity of a compressor niche 50 that projects into the refrigerating chamber 16. The depositing-compartment section 26, on account of its height dimensions, is suitable, in particular, for storing large-volume types of vegetable, for example, cauliflower and lettuce or the like.

Provided above the depositing compartment 20 is a further depositing compartment 27 that, like the depositing compartment 20, can be moved out of the refrigerating chamber 16 by way of telescopic rails 19. In contrast to the depositing compartment 20, the depositing compartment 27 has a compartment base 29 that is offset in the manner of a step 28 transversely to its movement direction. The compartment base 29, which is offset in a step-like manner over the length of the depositing compartment 27, produces two depositing-compartment sections 31 and 32 that are separated from one another by a partition wall 30 in the movement direction of the depositing compartment 27 and of which the compartment height, in the present case, is lower than the compartment height of the set-back depositing-compartment section 25. The latter, by virtue of the configuration of the step 22 and of the step 28 on the depositing compartment 27, is configured congruently with the likewise set-back depositing-compartment section 31, the set-back depositing-compartment sections 25 and 31 creating a stowage space 33 between these depositing-compartment sections in the depositing-compartment section 25 for refrigerator items in high multi-packs, for example, bottles or the like, which are set down in the upright position. On account of its low compartment depth in comparison with the other depositing-compartment sections, the depositing-compartment section 31 is suitable, in particular, for accommodating refrigerator items of low height, for example, eggs or the like. For such a purpose, the depositing-compartment section 31 is additionally equipped, in its region that is in the vicinity of the door, with an egg compartment base 34 that is suitable for storing eggs.

Provided at a distance above the depositing compartment 27 are two depositing compartments 40 that are spaced apart vertically one above the other, are configured in the form of a shallow tray, are borne on their side walls, like the depositing compartments 20 and 27, by telescopic rails 19, and can be moved out of the refrigerating chamber 16 with the aid of the telescopic rails 19. In addition to the orientation aid that is already made available by the coordinated configuration of the depositing compartments 20 and 27, the depositing compartments 40, which are completely different from the depositing compartments 20 and 27 in terms of configuration, provide a user with an additional orientation aid, for storing and for locating refrigerator items, in order to make it possible, in conjunction with the pull-out mechanisms of the depositing compartments, for the table refrigerator to be accessed in a user-friendly and impediment-free manner even for the elderly and physically handicapped.

In contrast to the exemplary embodiment that has been illustrated and described, the table refrigerator 10 may be equipped, in its top region, with a 3-star freezer compartment, beneath which one depositing compartment 40 is, then, provided above the already described configuration of the depositing compartments 20 and 27. Furthermore, as a modification of the exemplary embodiment that has been illustrated and described, it is conceivable, in the case of the table refrigerator 10 shown, to provide directly above the depositing compartment 27, instead of a depositing compartment 40, a further depositing compartment 27 of the same configuration.

We claim:

1. A free-standing refrigerator, comprising:

a heat-insulating housing defining therewithin a refrigerating chamber;

a door pivotally connected to said housing, said door pivoting about a vertical axis of rotation and closing said refrigerating chamber from the outside;

telescopic rails connected to said refrigerating chamber;

at least two depositing compartments for holding refrigerator items, said at least two depositing compartments:

being container-shaped; and being connected to respective ones of said telescopic rails in said refrigerating chamber and, thereby, moving in and out of said refrigerating chamber in a movement direction through said telescopic rails;

a first of said at least two depositing compartments:

having a loading opening;

having a substantially planar compartment base; and being offset at said loading opening by at least one step disposed transversely to said movement direction to form first accommodating chambers of different heights; and a second of said at least two depositing compartments disposed above said first depositing compartment in said refrigerating chamber, said second depositing compartment having a compartment base offset in a step transversely to said movement direction on at least one location to form second accommodating chambers of different heights.

2. The refrigerator according to claim 1, wherein:

said first accommodating chambers are separated along said at least one step by a first wall; and said second accommodating chambers are separated along said step by a second wall.

3. The refrigerator according to claim 1, wherein said at least one step and said step form set-back sections in each of said first and second depositing compartments, said set-back sections at least partially coincide with one another.

4. The refrigerator according to claim 3, wherein said setback sections substantially coincide with one another.

5. The refrigerator according to claim 1, wherein:

said refrigerating chamber has a floor; and said substantially planar compartment base is in a region of said refrigerating chamber in a vicinity of said floor.

6. The refrigerator according to claim 1, wherein:

said refrigerating chamber has a floor; and said first substantially planar compartment base is adjacent said floor.

7. The refrigerator according to claim 1, wherein:

said first accommodating chambers each have a height formed by said at least one step; and said height is greater than a height of each of said second accommodating chambers.

8. The refrigerator according to claim 1, wherein:

said refrigerating chamber has a floor, a side, and a compressor niche projecting into said refrigerating chamber at said side;

said first depositing compartment is in a vicinity of said floor;

one of said first accommodating chambers:

has a first compartment section shorter than a second compartment section of another of said first accommodating chambers;

has a first compartment height greater than a second compartment height of said another of said first accommodating chambers;

is seated in front of said compressor niche with respect to said door; and is a vegetable compartment.

9. The refrigerator according to claim 8, wherein:

said vegetable compartment is wider than said second compartment section;

said second compartment section is:

disposed alongside said first compartment section in said movement direction of said first depositing compartment; and a set-down surface for storage items in high multi-packs.

10. The refrigerator according to claim 8, wherein said second depositing compartment has a depositing-compartment section that is:

of low accommodating height;

an egg compartment; and disposed above said another of said first accommodating chambers of said first depositing compartment.

11. The refrigerator according to claim 8, wherein said second depositing compartment has a depositing-compartment section that:

has an accommodating height and an egg compartment; and is disposed above said another of said first accommodating chambers of said first depositing compartment.

12. The refrigerator according to claim 11, wherein said depositing-compartment section of said second depositing compartment is at least partly an egg compartment.

13. The refrigerator according to claim 1, including at least one further depositing compartment connected to respective other rails of said telescopic rails in said refrigerating chamber and, thereby, moving in and out of said refrigerating chamber in said movement direction through said other rails, said at least one further depositing compartment configured as a shallow tray, and said other rails being disposed above said second depositing compartment.

14. The refrigerator according to claim 1, including at least one tray-shaped depositing compartment connected to respective other rails of said telescopic rails in said refrigerating chamber and, thereby, moving in and out of said refrigerating chamber in said movement direction through said other rails, said other rails being disposed above said second depositing compartment in said refrigerating chamber.

15. The refrigerator according to claim 1, wherein said door has an inside surface directed toward said refrigerating chamber and said inside surface is at least substantially a planar surface.

16. The refrigerator according to claim 14, wherein said door has a top section defining at least one accommodating hollow for storing small-format refrigerator items.

17. The refrigerator according to claim 14, wherein said door has on a top section thereof at least one shallow accommodating hollow for storing small-format refrigerator items.

18. The refrigerator according to claim 1, wherein said freestanding refrigerator is one of a table refrigerator and an upright refrigerator and said door is a heat-insulating door.

19. A table refrigerator, comprising:

a heat-insulating housing defining therewithin a refrigerating chamber;

a door pivotally connected to said housing, said door pivoting about a vertical axis of rotation and closing said refrigerating chamber from the outside;

telescopic rails connected to said refrigerating chamber;

at least two depositing compartments for holding refrigerator items, said at least two depositing compartments:
being container-shaped; and
being connected to respective ones of said telescopic rails in said refrigerating chamber and, thereby, moving in and out of said refrigerating chamber in a movement direction through said telescopic rails;

a first of said at least two depositing compartments:
having a loading opening;
having a substantially planar compartment base; and
being offset at said loading opening by at least one step disposed transversely to said movement direction to form first accommodating chambers of different heights; and a second of said at least two depositing compartments disposed above said first depositing compartment in said refrigerating chamber, said second depositing compartment having a compartment base offset in a step transversely to said movement direction on at least one location to form second
commodating chambers of different heights.

20. An upright refrigerator, comprising:

a heat-insulating housing defining therewithin a refrigerating chamber;

a door pivotally connected to said housing, said door pivoting about a vertical axis of rotation and closing said refrigerating chamber from the outside;

telescopic rails connected to said refrigerating chamber;

at least two depositing compartments for holding refrigerator items, said at least two depositing compartments:
being container-shaped; and
being connected to respective ones of said telescopic rails in said refrigerating chamber and, thereby, moving in and out of said refrigerating chamber in a movement direction through said telescopic rails;

a first of said at least two depositing compartments:
having a loading opening;
having a substantially planar compartment base; and
being offset at said loading opening by at least one step disposed transversely to said movement direction to form first accommodating chambers of different heights; and a second of said at least two depositing compartments disposed above said first depositing compartment in said refrigerating chamber, said second depositing compartment having a compartment base offset in a step transversely to said movement direction on at least one location to form second accommodating chambers of different heights.

21. A free-standing refrigerator, comprising:

a heat-insulating housing defining therewithin a refrigerating chamber;

a door pivotally connected to said housing, said door pivoting about a vertical axis of rotation and closing said refrigerating chamber from the outside;

telescopic rails connected to said refrigerating chamber;

at least two depositing compartments for holding refrigerator items, said at least two depositing compartments being container-shaped; and
being connected to said telescopic rails in said refrigerating chamber and, thereby, moving in and out of said refrigerating chamber in a movement direction through correspondingly associated ones of said telescopic rails;

a first of said at least two depositing compartments having at least one step disposed parallel to said movement direction to form first accommodating chambers of different heights and having different depths; and a second of said at least two depositing compartments disposed above said first depositing compartment in said refrigerating chamber, said second depositing compartment having a step-shaped compartment base offset transverse to said movement direction on at least one location to form second accommodating chambers of different heights.

* * * * *